US006531054B1

(12) United States Patent
Gerritsen et al.

(10) Patent No.: US 6,531,054 B1
(45) Date of Patent: Mar. 11, 2003

(54) PROCESS FOR EFFECTING DEEP HDS OF HYDROCARBON FEEDSTOCKS

(75) Inventors: Leendert Arie Gerritsen, Lunteren (NL); Seck Leong Lee, Amsterdam (NL)

(73) Assignee: AKZO Nobel, N.V., Arnhem (NL)

( * ) Notice: Subject to any disclaimer, the term of this patent is extended or adjusted under 35 U.S.C. 154(b) by 510 days.

(21) Appl. No.: 09/049,938

(22) Filed: Mar. 30, 1998

Related U.S. Application Data

(60) Provisional application No. 60/041,897, filed on Apr. 11, 1997.

(30) Foreign Application Priority Data

Apr. 11, 1997 (EP) ..... 97105996

(51) Int. Cl.[7] ..... C10G 45/04; C10G 45/60

(52) U.S. Cl. ..... 208/216 R; 208/210; 208/213; 208/217

(58) Field of Search ..... 208/210, 213, 208/216 R, 217

(56) References Cited

U.S. PATENT DOCUMENTS

| | | | | | |
|---|---|---|---|---|---|
| 3,349,027 | A | * | 10/1967 | Carr et al. | 208/210 |
| 3,686,095 | A | * | 8/1972 | Coons et al. | 208/216 |
| 4,008,149 | A | * | 2/1977 | Itoh et al. | 208/216 |
| 4,048,060 | A | | 9/1977 | Riley | 208/210 |
| 4,054,508 | A | * | 10/1977 | Milstein et al. | 208/89 |
| 4,619,759 | A | * | 10/1986 | Myers et al. | 208/210 |
| 4,657,663 | A | * | 4/1987 | Gardner et al. | 208/210 |
| 5,198,100 | A | * | 3/1993 | Aldridge et al. | 208/89 |
| 5,246,569 | A | * | 9/1993 | Heinerman et al. | 208/216 R |

FOREIGN PATENT DOCUMENTS

| | | |
|---|---|---|
| EP | 0 203 228 A | 12/1986 |
| EP | 0 464 931 A | 1/1992 |
| EP | 0 497 435 A | 8/1992 |
| EP | 0 523 679 A | 1/1993 |
| GB | 2 075 358 A | 11/1981 |

* cited by examiner

*Primary Examiner*—Walter D. Griffin
*Assistant Examiner*—Tam M. Nguyen
(74) *Attorney, Agent, or Firm*—Oliff & Berridge, PLC

(57) ABSTRACT

The invention pertains to a process for reducing the sulphur content of a hydrocarbon feedstock to a value of less than 500 ppm, which process comprises contacting a feedstock with a 95% boiling point of 450° C. or less and a sulphur content of 0.1 wt. % or more in the presence of hydrogen under conditions of elevated temperature and pressure with a first catalyst comprising a Group VI hydrogenation metal component and a Group VIII hydrogenation metal component on an oxidic carrier, after which at least part of the effluent from the first catalyst is led to a second catalyst comprising a Group VI hydrogenation metal component and a Group VIII hydrogenation metal component on an oxidic carrier which comprises 1 to 15 wt. % of silica, calculated on the weight of the catalyst.

The use of a silica-containing catalyst in the second bed shows an improvement over the use of a second catalyst with an alumina carrier in the production of products with a sulphur content of less than 500 ppm, preferably less than 350 ppm. An improvement in hydrodenitrogenation activity is also obtained.

6 Claims, No Drawings

PROCESS FOR EFFECTING DEEP HDS OF HYDROCARBON FEEDSTOCKS

This nonprovisional application claims the benefit of U.S. Provisional Application No. 60/041,897, filed Apr. 11, 1997.

The present invention relates to a process for effecting deep HDS of hydrocarbon feedstocks and additionally obtaining an efficient removal of nitrogen.

In an effort to regulate $SO_2$ emissions from the burning of fuels, the environmental regulations as to the sulphur content of fuels, in particular diesel fuels, are becoming more and more strict. Until recently, a sulphur content for diesel fuel of between 0.05 and 0.1 wt. % was acceptable, but for the near future it is expected that diesel fuels will be required to have a sulphur content of less than 500 ppm, while for the more distant future a requirement of a maximum sulphur level of 350 ppm or even lower is foreseen. In consequence, there is an increasing need for catalyst systems which can decrease the sulphur content of a hydrocarbon feedstock with a 95% boiling point of 450° C. or less and a sulphur content of 0.1 wt. % or more to a value of less than 500 ppm (0.05 wt. %), preferably to a value of less than 350 ppm, or even to a value of less than 200 ppm, calculated as elemental sulphur on the total liquid product.

EP 0 464 931 describes a process for the concomitant hydrodesulphurisation and aromatics hydrogenation of a diesel boiling range feedstock which contains 0.01–2 wt. %, preferably 0.05–1.5 wt. % of sulphur, in which the feedstock is contacted with a catalyst comprising Ni, W, and optionally P on an alumina support, after which the feedstock is led to a second catalyst comprising Co and/or Ni, Mo, and optionally P on an alumina carrier.

EP-A 0 523 679 describes a process for the production of low-sulphur diesel oil in which the feedstock is contacted in two steps with a hydrotreating catalyst, the first step being carried out at a temperature of 350–450° C. and the second step at a temperature of 200–300° C. In the first step, the sulphur content of the feedstock is reduced to 0.05 wt. % or less. In the second step, the Saybolt colour is brought to a value of −10 or higher. The catalyst is stated to be a conventional hydrotreating catalyst. In the examples catalysts containing Ni and/or Co and Mo on an alumina carrier are applied.

However, it has been found that the catalyst systems described in the above references are not active enough. That is, they do not provide sufficient removal of sulphur and nitrogen. There is need for a catalyst system which, at comparable conditions, can better effect deep HDS and nitrogen removal from hydrocarbon feedstocks with a 95% boiling point of 450° C. or less.

In the context of the present specification the term deep HDS means the reduction of the sulphur content of a hydrocarbon feedstock to a value of less than 500 ppm, preferably less than 350 ppm, and optionally to a value of less than 200 ppm, calculated by weight of elemental sulphur on the total liquid product, as determined in accordance with ASTM D4294. The present invention provides a process which applies a catalyst system which meets this demand.

The present invention accordingly is directed to a process for reducing the sulphur content of a hydrocarbon feedstock to a value of less than 500 ppm, comprising contacting a feedstock with a 95% boiling point of 450° C. or less and a sulphur content of 0.1 wt. % or more in the presence of hydrogen under conditions of elevated temperature and pressure with a first catalyst comprising a Group VI hydrogenation metal component and a Group VIII hydrogenation metal component on an oxidic carrier, after which at least part of the effluent from the first catalyst is led to a second catalyst comprising a Group VI hydrogenation metal component and a Group VIII hydrogenation metal component on an oxidic carrier which comprises 1 to 15 wt. % of silica, calculated on the weight of the catalyst.

Incidentally, EP 0203228 describes a process for catalytically hydrotreating hydrocarbon oils, in which heavy hydrocarbon feedstocks are contacted with a two-bed catalyst system in which the first bed contains a phosphorus compound while the second bed comprises less than 0.5% of said phosphorus compound. In the example the reaction is steered to obtain 0.3 wt. % of sulphur (3000 ppm). Further, GB 2057358 describes a process for lowering the sulphur content and pour point of heavy hydrocarbon feedstocks, such as vacuum gas oils, applying a first catalyst comprising hydrogenation metals on an oxidic carrier, after which the effluent is contacted with a second catalyst having a silica-content higher than 5 wt. %. The sulphur contents obtained in that reference with a second stage catalyst containing less than 15% silica are above 1600 ppm.

Neither of these references teaches obtaining sulphur contents less than 500 ppm with a catalyst containing less than 15 wt. % of silica in the second bed.

The feedstock suitable for use in the process according to the invention has a 95% boiling point, as determined according to ASTM D-1160, of 450° C. or less, preferably 420° C. or less, more preferably 400° C. or less. That is, 95 vol. % of the feedstock boils at a temperature of 450° C. or less, preferably 420° C. or less, more preferably 400° C. or less. Generally, the initial boiling point of the feedstock is above 100° C., preferably above 180° C. The feed contains 0.1 wt. % or more of sulphur, preferably 0.2 to 2.5 wt. % of sulphur, more preferably 0.5 to 2.0 wt. % of sulphur. The feedstock generally contains 20–1200 ppm nitrogen, preferably 30–800 ppm, more preferably 70–600 ppm. The metal content of the feedstock preferably is less than 5 ppm, more preferably less than 1 ppm (Ni+V). Examples of suitable feedstocks are feedstocks comprising one or more of straight run gas oil, light catalytically cracked gas oil, and light thermally cracked gas oil.

The catalyst to be used in the first step of the process according to the invention comprises a Group VI hydrogenation metal component and a Group VIII hydrogenation metal component on a porous inorganic oxide carrier. As examples of suitable carriers may be mentioned carriers comprising alumina, silica, magnesium oxide, zirconium oxide, titanium oxide, as well as carriers comprising combinations of two or more of these materials. Preference is given to carriers comprising alumina or alumina combined with silica, i.e., silica-alumina in which the amount of silica may be up to 10 wt. %, and more particularly up to 5 wt. %. More preferably, the carrier substantially consists of alumina. By "substantially consists of alumina" is meant that the carrier basically consists of alumina, but may contain minor amounts of other components as long as they do not substantially influence the catalytic properties of the catalyst. In general, carrier materials which show limited cracking activity are preferred.

The Group VI metal preferably is molybdenum, tungsten, or a mixture thereof. Generally, molybdenum is preferred. The Group VIII metal preferably is nickel, cobalt, or a mixture thereof, with nickel being preferred. The Group VI hydrogenation metal component generally is present in an amount of 5–50 wt. %, preferably 10–40 wt. %, more preferably 15–30 wt. %, calculated as trioxide. The Group VIl metal component generally is present in an amount of 0.5–10 wt. %, preferably 2–7 wt. %, calculated as oxide. In addition to the Group VI hydrogenation metal component and the Group VIII hydrogenation metal component, the catalyst may contain phosphorus. If the catalyst contains phosphorus, this compound generally is present in an amount of 0.5–10 wt. %, preferably 3–8 wt. %, calculated as $P_2O_5$.

The catalyst to be used in the second bed of the process according to the invention comprises a Group VI hydrogenation metal component and a Group VIII hydrogenation metal component on an oxidic carrier which comprises 1–15 wt. % of silica, calculated on the weight of the catalyst.

The upper limit of 15 wt. % for the silica-content of the second bed catalyst is governed by the desire to minimise the hydrocracking of the hydrocarbon feedstock. As indicated earlier, the process of the present invention is intended to effect removal of sulphur and nitrogen from a hydrocarbon feedstock. It is not intended to hydrocrack the feedstock to a product with a lower boiling range. Accordingly, the process of the present invention is carried out at such conditions that substantially no hydrocracking will occur during the process. In this context, conditions under which substantially no hydrocracking will occur are defined as conditions under which less than 20 wt. %, preferably less than 10 wt. %, more preferably less than 5 wt. % of the hydrocarbons in the feed with a boiling point above 196° C. is converted to product hydrocarbons with a boiling point below 196° C. The conversion to products boiling below 196° C. is given in the following formula:

$$\text{Conv. } 196^\circ\text{ C.}-(\text{wt }\%) = \frac{(\text{wt. product } 196^\circ\text{ C.}-) - (\text{wt. feed } 196^\circ\text{ C.}-)}{\text{wt. total feed}} \times 100\%$$

If the second bed catalyst were to contain more than 15 wt. % of silica, carrying out the process of the invention under such conditions that substantially no hydrocracking will occur will be difficult.

Preferably, the carrier of the second bed catalyst comprises silica and alumina. More preferably, the carrier substantially consists of alumina and silica in such an amount that the final catalyst contains 1–15 wt. % of silica, preferably 3–10 wt. %, calculated on the weight of the catalyst. By "substantially consists of alumina and silica" is meant that the carrier basically consists of alumina and silica, but may contain minor amounts of other components as long as they do not substantially influence the catalytic properties of the catalyst.

The Group VI metal preferably is molybdenum, tungsten, or a mixture thereof, with molybdenum generally being preferred. The Group VIII metal preferably is nickel, cobalt, or a mixture thereof, with cobalt generally being preferred. The Group VI hydrogenation metal component generally is present in an amount of 5–50 wt. %, preferably 10–40 wt. %, more preferably 15–30 wt. %, calculated as trioxide. The Group VIII metal component generally is present in an amount of 0.5–10 wt. %, preferably 2–7 wt. %, calculated as oxide. In addition to the Group VI hydrogenation metal component and the Group VIII hydrogenation metal, the catalyst may contain phosphorus. If the catalyst contains phosphorus, this compound generally is present in an amount of 0.5–10 wt. %, preferably 3–8 wt. %, calculated as $P_2O_5$.

It should be noted that it generally is preferred for the catalyst system to be used in the process according to the invention to comprise both nickel and cobalt as Group VIII hydrogenation metals. This can be achieved in various ways. It is possible for the first catalyst to comprise nickel as Group VIII hydrogenation metal while the second catalyst comprises cobalt as Group VIII hydrogenation metal, or vice versa. It is also possible for the first catalyst or the second catalyst or both to comprise both nickel and cobalt. The embodiment in which the first catalyst comprises nickel as Group VIII hydrogenation metal while the second catalyst comprises cobalt as Group VIII hydrogenation metal is deemed preferable.

The catalysts may be prepared by processes known in the art. The catalysts are generally employed in the form of spheres or extrudates. Examples of suitable types of extrudates have been disclosed in the literature. Highly suitable for use are cylindrical particles (which may be hollow or not) as well as symmetrical and asymmetrical polylobed particles (3 or 4 lobes).

In the process according to the invention the catalysts are generally employed in the sulphided form. To this end use may be made of ex-situ as well as in-situ (pre)sulphidation techniques. Such methods are known to the skilled person. The ratio between the first catalyst and the second catalyst generally is between 10:90 and 90:10, preferably between 25:75 and 75:25, more preferably between 40:60 and 60:40. The catalysts may be present in the same reactor or in different reactors.

The process according to the invention is carried out at elevated temperature and pressure. The first step generally is carried out at a temperature of 200–450° C., preferably 300–430° C. The second step is also generally carried out at a temperature of 200–450° C., preferably 300–430° C. The temperature in the first and the second step may be the same, but this is not required. The process according to the invention generally is carried out at a reactor inlet hydrogen partial pressure of 10–200 bar, preferably 10–100 bar, more preferably 15–50 bar. It is preferred for reasons of processing technology that the pressures in the first bed and in the second bed are the same. However, this is not required. The liquid hourly space velocity for both beds preferably is between 0.1 and 10 vol./vol.h, more preferably between 0.5 and 4 vol./vol.h. The $H_2$/oil ratios generally are in the range of 50–2000 NI/l, preferably in the range of 80–500 NI/l.

The process conditions are selected in such a way that the sulphur content of the total liquid effluent is less than 500 ppm, preferably less than 350 ppm. If so desired it is possible to effect the process under such conditions that the sulphur content of the total liquid effluent is less than 200 ppm. The exact process conditions will depend, int. al., on the nature of the feedstock, the desired degree of hydrodesulphurisation, and the nature of the catalyst system. In general, a higher temperature, a higher hydrogen partial pressure, and a lower space velocity will decrease the sulphur content of the final product. The selection of the appropriate process conditions to obtain the desired sulphur content in the product is well within the scope of the person skilled in the art of hydroprocessing.

As indicated above, the process is steered on the sulphur content of the effluent. This will be accompanied by the removal of nitrogen. Preferably, at least 20% of the nitrogen present in the feed is removed, more preferably at least 35%, even more preferably at least 50%. The percentage of nitrogen removal is calculated from the amount of nitrogen present in the feed and the amount of nitrogen present in the total liquid product, both determined in accordance with ASTM D-4629.

The two catalyst beds to be used in the process according to the invention can be present in the same or in different reactors. The process can be carried out in upflow mode or in downflow mode. In the context of the present specification, the term first catalyst should be interpreted as the catalyst which first comes into contact with the hydrocarbon feed.

If so desired it is possible to effect an intermediate phase separation between the two process steps to remove the ammonia and hydrogen sulphide formed in the first step from the system.

If so desired, it is possible to fractionate the effluent from the first catalyst bed so as to select a fraction with an appropriate boiling range to be fed to the second bed. However, this measure generally is not necessary. If a fractionation of the resulting product is necessary, it is generally best carried out after the second step.

If so desired, one may recycle part of the effluent from the first step back to the first step, or one may recycle part of the effluent from the second step back to either the first step or the second step.

Sometimes it may be desirable to subject the product of the second step to a further processing step such as, e.g., a step to improve the colour of the product or to specifically hydrogenate the aromatics present in the product.

Any additional step may be carried out under the same conditions as given above for the two earlier steps of the process according to the invention. A third process step to improve the colour of the process can comprise contacting at least part of the effluent from the second step with a conventional hydrotreating catalyst, for example a catalyst meeting the requirements for the first catalyst described above, at a temperature which is at least 25° C. lower than the temperature applied in the second step of the process according to the invention. Selection of the optimum process conditions is within the scope of the skilled person. Intermediate phase separation, fractionation, and/or liquid recycle may be applied if appropriate.

If a third catalyst bed is applied, the volume ratio between the first catalyst, the second catalyst, and the third catalyst may, in general, vary between wide ranges 1 0 in which each of the catalysts can make up 5–90% of the total amount of catalyst. Preferably, each catalyst makes up 10–70 wt. % of the total amount of catalyst.

EXAMPLE

The following catalysts were used.

The first catalyst comprised 20 wt. % of molybdenum, calculated as trioxide, 4 wt. % of nickel, calculated as oxide, and 6 wt. % of phosphorus, calculated as $P_2O_5$, the balance being alumina.

The second catalyst according to the invention comprised 20 wt. % of molybdenum, calculated as trioxide, 4 wt. % of cobalt, calculated as oxide, 5 wt. % of silica, and the balance alumina.

The comparative second catalyst had the same composition as the second catalyst according to the invention, except that it did not contain silica.

Two sets of catalysts were tested side by side in an upflow tubular reactor. A first reactor tube contained the first catalyst followed by the silica-containing second catalyst according to the invention in a volume ratio of 50:50. A second reactor contained the first catalyst followed by the comparative silica-free second catalyst in a volume ratio of 50:50. In this context the term "first catalyst" refers to the catalyst which is first contacted with the hydrocarbon feed. Each reactor tube contained 75 ml of catalyst homogeneously intermixed with 80 ml of carborundum particles.

The catalysts were presulphided using an SRLGO in which dimethyl disulphide had been dissolved to a total S content of 2.5 wt. %.

The feed applied had the following properties.

| | Light gas oil |
|---|---|
| Nitrogen (ASTM D-4629) (ppmwt) | 113 |
| Sulphur (ASTM D-4294) (wt. %) | 1.6145 |
| Density 15° C. (g/ml) | 0.8359 |
| Dist. (° C.) | D1160 |
| IBP | 218 |
| 5 vol. % | 258 |
| 10 vol. % | 275 |
| 30 vol. % | 299 |
| 50 vol. % | 322 |
| 70 vol. % | 349 |
| 90 vol. % | 382 |
| 95 vol. % | 396 |
| FBP | 403 |

Three sets of test conditions were applied to get product sulphur contents of about 0.1 wt. % sulphur, about 400 ppm wt. sulphur, and less than 200 ppm sulphur, respectively. The test conditions and the results obtained therewith are given in the following tables.

In these tables the term RVA-HDS stands for the relative volume activity in hydrodesulphurisation of the tested catalyst system as compared with a standard catalyst system. The RVA-HDS is calculated as follows: for each catalyst system the HDS reaction rate constant (k-HDS) was calculated on the basis of the obtained sulphur content of the product in relation to the sulphur content of the feedstock. The reaction rate constant for the comparative catalyst system was valued at 100. A calculation of the reaction rate constants of the catalyst system according to the invention resulted in the RVA-HDS figure.

Test condition 1: HDS to about 0.1 wt. % S

Reaction conditions

| | |
|---|---|
| Temperature (° C.) | 330 |
| Pressure (bar) | 35 |
| $H_2$/oil (Nl/l) | 150 |
| LHSV (h-1) | 3.5 |
| Days | 2 |

Test results

| | product sulphur (ppm) | RVA-HDS | product nitrogen (ppm) |
|---|---|---|---|
| System according to the invention | 1160 | 1.09 | 82 |
| Comparative system | 1310 | 100 | 91 |

Test condition 2: HDS to about 400 ppm S

Reaction conditions

| | |
|---|---|
| Temperature (° C.) | 350 |
| Pressure (bar) | 35 |

-continued

| | |
|---|---|
| $H_2$/oil (Nl/l) | 150 |
| LHSV (h-1) | 1.8 |
| Days | 2 |

Test results

| | product sulphur (ppm) | RVA-HDS | product nitrogen (ppm) |
|---|---|---|---|
| System according to the invention | 470 | 114 | 61 |
| Comparative system | 570 | 100 | 71 |

Test condition 3: HDS to below 200 ppm S

Reaction conditions

| | |
|---|---|
| Temperature (° C.) | 363 |
| Pressure (bar) | 35 |
| $H_2$/oil (Nl/l) | 150 |
| LHSV (h-1) | 1.5 |
| Days | 2 |

Test results

| | product sulphur (ppm) | RVA-HDS | product nitrogen (ppm) |
|---|---|---|---|
| System according to the invention | 100 | 128 | 36 |
| Comparative system | 150 | 100 | 42 |

It appears that when effecting HDS to a sulphur content of about 0.1 wt. % the use of a silica-containing catalyst in the second bed shows some improvement over a catalyst system in which the second catalyst is silica-free. When effecting deep HDS to a sulphur-content of less than 500 ppm, the improvement obtained with the catalyst system according to the invention over the silica-free comparative catalyst system increases. This increase in activity is even more pronounced when effecting deep HDS to a sulphur content of less than 350 ppm.

It also appears that the use of the catalyst system according to the invention results in an improved removal of nitrogen as compared to the comparative catalyst system. No RVA figures have been calculated because, although the differences in nitrogen content are significant, the RVA values are less so, because of the relatively large error margin introduced by the measuring error at lower ppm levels.

What is claimed is:

1. A process for reducing the sulphur content of a hydrocarbon feedstock to a value of less than 500 ppm, comprising contacting a feedstock with a 95% boiling point of 450° C. or less and a sulphur content of 0.1 wt. % or more in the presence of hydrogen under conditions of elevated temperature and pressure with a first catalyst comprising a Group VI hydrogenation metal component and a Group VIII hydrogenation metal component on an oxidic carrier, after which at least part of the effluent from the first catalyst is contacted with a second catalyst comprising a Group VI hydrogenation metal component and a Group VIII hydrogenation metal component on an oxidic carrier which comprises 3 to 15 wt. % of silica, calculated on the weight of the catalyst, to achieve the reduction in the sulphur of the hydrocarbon feedstock to less than 500 ppm.

2. The process according to claim 1 in which the process conditions are selected such that the sulphur content of the hydrocarbon feedstock is reduced to a value of less than 350 ppm.

3. The process according to claim 1 in which the first catalyst comprises molybdenum as Group VI metal component and nickel or a mixture of nickel and cobalt as Group VIII metal component on a carrier comprising alumina.

4. The process according to claim 1 in which the second catalyst comprises molybdenum as Group VI metal component and cobalt or a mixture of nickel and cobalt as Group VIII metal component on a carrier comprising alumina and 3–15 wt. % of silica, calculated on the weight of the catalyst.

5. The process according to claim 4 in which the carrier of the second catalyst contains 3–10 wt. % of silica, calculated on the weight of the catalyst, and the balance alumina.

6. The process according to claim 1 wherein the amount of the first catalyst and the amount of the second catalyst in the process is such that a volume ratio between the first catalyst and the second catalyst is between 10:90 and 90:10.

* * * * *

UNITED STATES PATENT AND TRADEMARK OFFICE

CERTIFICATE OF CORRECTION

PATENT NO. : 6,531,054 B1 
DATED : March 11, 2003
INVENTOR(S) : Leendert Arie Gerritsen and Seck Leong Lee It is certified that error appears in the above-identified patent and that said Letters Patent is hereby corrected as shown below:

Title page,
Item [73], Assignee, change "AKZO" to -- Akzo --.
Item [56], U.S. PATENT DOCUMENTS, "5,198,100", change "3/1993" to -- 5/1993 --.

Column 1,
Line 58, change "D4294" to -- D-4294 --.

Column 3,
Line 1, change "Vil" to -- VIII --

Column 4,
Line 42, change "NI/l" to -- Nl/l -- (change both occurrences).

Column 5,
Line 41, delete "1 0".

Column 6,
Line 51, change "NI/l" to -- Nl/l --.
Line 58, change "1.09" to -- 109 --.

Signed and Sealed this

Twenty-ninth Day of July, 2003

JAMES E. ROGAN
*Director of the United States Patent and Trademark Office*